US006406260B1

(12) United States Patent
Trindade et al.

(10) Patent No.: US 6,406,260 B1
(45) Date of Patent: Jun. 18, 2002

(54) HEAT TRANSFER PROMOTION STRUCTURE FOR INTERNALLY CONVECTIVELY COOLED AIRFOILS

(75) Inventors: Ricardo Trindade, Montreal; Michael Papple, Nun's Island, both of (CA); William Abdel-Messeh, Rocky Hill, CT (US); Ian Tibbott, Lichfield (GB)

(73) Assignee: Pratt & Whitney Canada Corp., Longueuil (CA)

( * ) Notice: Subject to any disclaimer, the term of this patent is extended or adjusted under 35 U.S.C. 154(b) by 0 days.

(21) Appl. No.: 09/425,173

(22) Filed: Oct. 22, 1999

(51) Int. Cl.[7] ..... F01D 5/18
(52) U.S. Cl. ..... 416/96 R; 416/97 R; 415/115
(58) Field of Search ..... 415/115; 416/96 R, 416/97 V, 97 A, 96 A, 95

(56) References Cited

U.S. PATENT DOCUMENTS

| | | | | |
|---|---|---|---|---|
| 2,566,928 A | | 9/1951 | Carter | |
| 3,151,675 A | | 10/1964 | Lysholm | |
| 3,528,751 A | | 9/1970 | Quinones et al. | |
| 3,533,711 A | | 10/1970 | Kercher | |
| 3,741,285 A | | 6/1973 | Kuethe | |
| 4,176,713 A | | 12/1979 | Fisher | |
| 4,180,373 A | | 12/1979 | Moore et al. | |
| 4,416,585 A | | 11/1983 | Abdel-Messeh | |
| 4,514,144 A | | 4/1985 | Lee | |
| 4,638,628 A | | 1/1987 | Rice | |
| 4,770,608 A | | 9/1988 | Anderson et al. | |
| 4,786,233 A | | 11/1988 | Shizuya et al. | |
| 5,052,889 A | | 10/1991 | Abdel-Messeh | |
| 5,342,172 A | | 8/1994 | Coudray et al. | |
| 5,536,143 A | | 7/1996 | Jacala et al. | |
| 5,695,320 A | * | 12/1997 | Kercher | 416/97 R |
| 5,695,321 A | * | 12/1997 | Kercher | 416/97 R |
| 5,700,132 A | * | 12/1997 | Lampes et al. | 416/97 R |
| 6,068,445 A | * | 5/2000 | Beeck et al. | 416/96 R |
| 6,089,826 A | * | 7/2000 | Tomita et al. | 416/96 R |
| 6,116,854 A | * | 9/2000 | Yuri | 416/97 R |
| 6,227,804 B1 | * | 5/2001 | Koga et al. | 46/96 R |

FOREIGN PATENT DOCUMENTS

| | | |
|---|---|---|
| DE | 19526917 | 1/1997 |
| EP | 34961 | 9/1981 |
| EP | 0 852 285 | 7/1998 |
| EP | 0 939 196 | 9/1999 |
| GB | 1355558 | 6/1974 |
| GB | 1410014 | 10/1975 |
| GB | 2112467 | 7/1983 |
| JP | 0001804 | 7/1986 |

OTHER PUBLICATIONS

Transactions of ASME, Journal of heat transfer, vol. 100, p. 520, Aug. 1978, J.M. Bentley, T.K. Snyder, L.R. Glicksman, W.M. Rohsenow.

* cited by examiner

*Primary Examiner*—F. Daniel Lopez
*Assistant Examiner*—Richard Woo
(74) *Attorney, Agent, or Firm*—Todd D. Bailey

(57) ABSTRACT

A cooled airfoil has an internal cooling passage in which a plurality of trip strips are arranged to effect variable coolant flow and heat transfer coefficient distribution so as to advantageously minimize the amount of coolant flow required to adequately cool the airfoil structure. In one embodiment, this is accomplished by varying the dimensions of the trip strips along a transversal axis relative to the cooling passage.

41 Claims, 6 Drawing Sheets

Prior Art

HEAT TRANSFER PROMOTION STRUCTURE FOR INTERNALLY CONVECTIVELY COOLED AIRFOILS

BACKGROUND OF THE INVENTION

1. Field of the Invention

The present invention relates to the cooling of components exposed to hot gas atmosphere and, more particularly, pertains to internally convectively cooled airfoil structures.

2. Description of the Prior Art

It is well known to cool airfoil structures, such as gas turbine blades or vanes, exposed to a hot gas atmosphere by circulating a cooling fluid through internal cooling passages defined within the airfoil structures in order to reduce the level of thermal stresses and reduce the peak airfoil temperatures in the airfoil structures and, thus, preserve the structural integrity and the service life thereof.

In gas turbine applications, the airfoil structures are typically air cooled by a portion of the pressurized air emanating from a compressor of the gas turbine engine. In order to preserve the overall gas turbine engine efficiency, it is desirable to use as little of pressurized air as possible to cool the airfoil structures. Accordingly, efforts have been made to efficiently use the cooling air. For instance, GB laid-open Patent Application No. 2,112,467 filed on Dec. 3, 1981 in the names of Schwarzmann et al. discloses a coolable airfoil having a leading edge cooling passage in which a plurality of identical and uniform sized trip strips are oriented at an angle to a longitudinal axis of the cooling passage in order to increase turbulence in the leading edge region of the blade, which is typically the most thermally solicited portion of the airfoil.

U.S. Pat. No. 4,416,585 issued on Nov. 22, 1983 to Abdel-Messeh and U.S. Pat. No. 4,514,144 issued on Apr. 30, 1985 to Lee both disclose a cooled blade having an internal cooling passage in which pairs of uniform sized ribs are angularly disposed to form a channel therebetween for channeling the cooling fluid along a selected flow path in order to increase heat transfer coefficient while at the same time minimizing the cooling fluid pressure drop in the internal cooling passage.

Although the heat transfer promotion structures described in the above-mentioned references are effective, it has been found that there is a need for a new and improved heat transfer promotion structure which allows for variable coolant flow and heat transfer coefficient distribution which can be set in accordance with a non-uniform external heat load.

SUMMARY OF THE INVENTION

It is therefore an aim of the present invention to provide a new and improved heat transfer promotion structure which is adapted to efficiently use cooling fluid to convectively cool a gas turbine airfoil structure.

It is also an aim of the present invention to provide such a heat transfer promotion structure which allows for variable cooling flow and heat transfer coefficient distributions.

Therefore, in accordance with the present invention there is provided a coolable gas turbine airfoil structure having a leading edge, a leading edge internal cooling passage through which a cooling fluid is circulated to convectively cool the airfoil structure, and a heat transfer promotion structure provided within the leading edge internal cooling passage. The heat transfer promotion structure comprises a plurality of trip strips arranged to cause the cooling fluid to flow towards the leading edge in a pair of counter-rotating vortices, thereby promoting heat transfer at the leading edge.

In accordance with a further general aspect of the present invention, there is provided a cooled airfoil structure for a gas turbine engine, comprising first and second opposed side walls joined together at longitudinally extending leading and trailing edges, at least one longitudinally extending internal cooling passage for passing a cooling fluid therethrough to convectively cool the airfoil structure, and a heat transfer promotion structure provided within the internal cooling passage. The heat transfer promotion structure includes a plurality of trip strips arranged inside the internal cooling passage to effect a variable heat transfer coefficient distribution. Each of the trip strips has a height (h) and a width (w) defining a w/h ratio. Within the plurality of trip strips, at least one of the height (h), the width (w) and the w/h ratio is varied along a transversal axis relative to the internal cooling passage. This advantageously provides variable flow and heat transfer coefficient distribution, thereby allowing to reduce cooling flow requirements.

In accordance with a further general aspect of the present invention, there is provided a method of cooling a leading edge of a gas turbine engine airfoil having a leading edge internal cooling passage extending between first and second side walls, comprising the steps of: providing a heat transfer promotion structure within the leading edge internal cooling passage, directing a cooling fluid into the leading edge internal cooling passage, and causing said cooling fluid to flow towards the leading edge in a pair of counter-rotating vortices, thereby promoting heat transfer at the leading edge.

BRIEF DESCRIPTION OF THE DRAWINGS

Having thus generally described the nature of the invention, reference will now be made to the accompanying drawings, showing by way of illustration a preferred embodiment thereof, and in which:

FIG. 2*a* is a cross-sectional view taken along line 2*a*—2*a* of FIG. 1;

DESCRIPTION OF THE PREFERRED EMBODIMENTS

Figure 1:
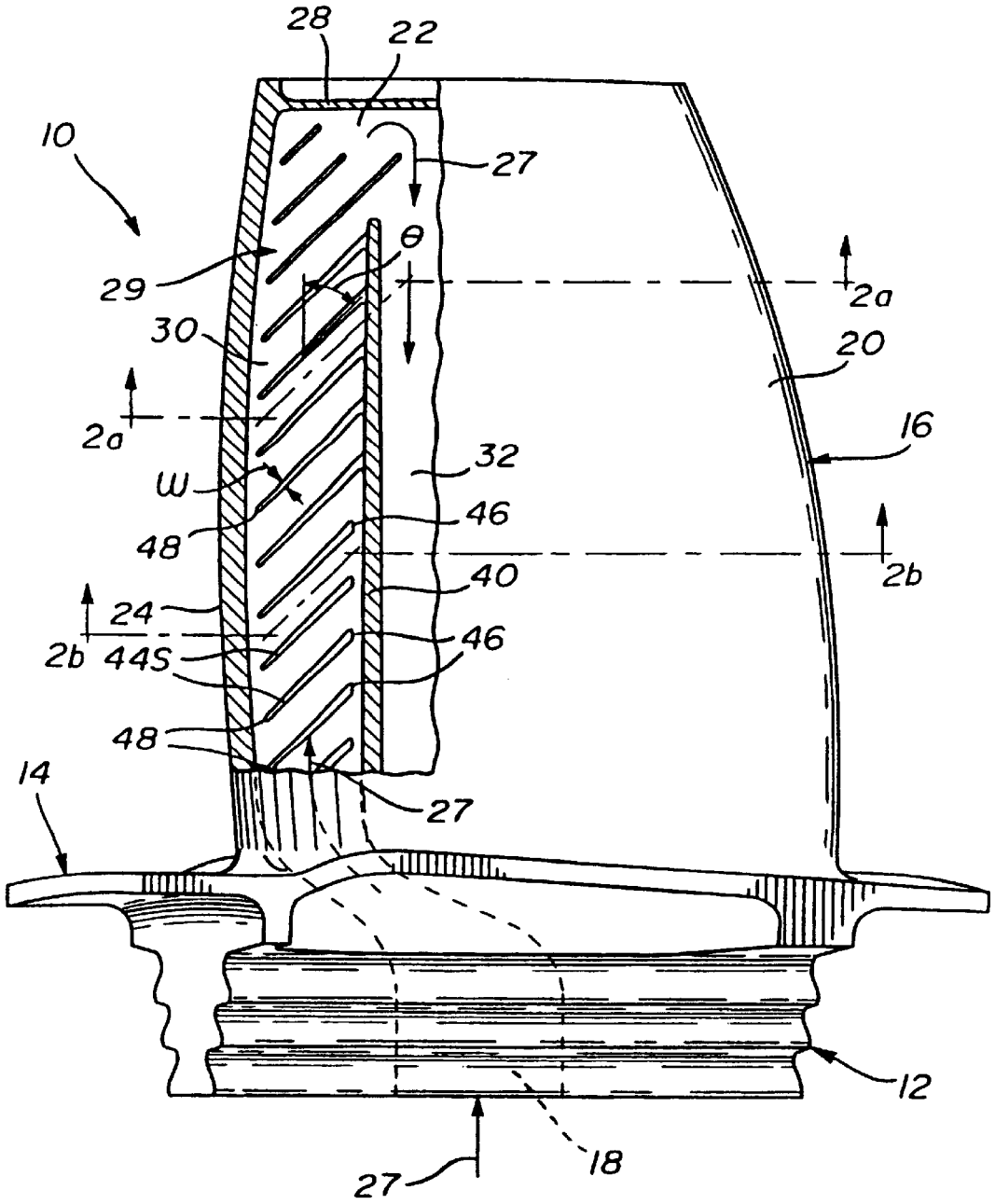
FIG. 1 is a partly broken away longitudinal sectional view of an internally convectively cooled blade in accordance with a first embodiment of the present invention.
Figure 2B:
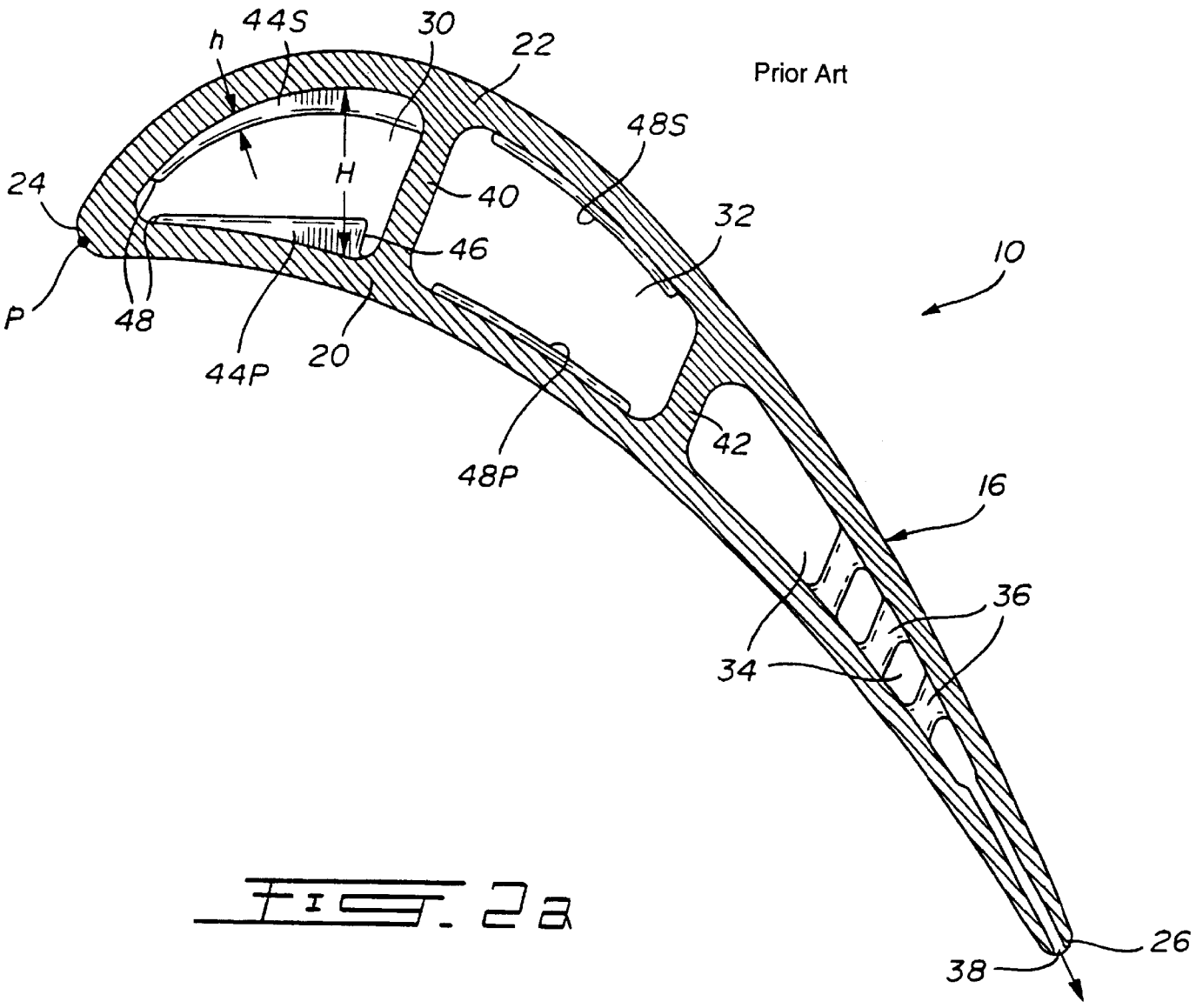
FIG. 2*b* is a cross-sectional view taken along line 2*b*—2*b* of FIG. 1.
Figure 2B:
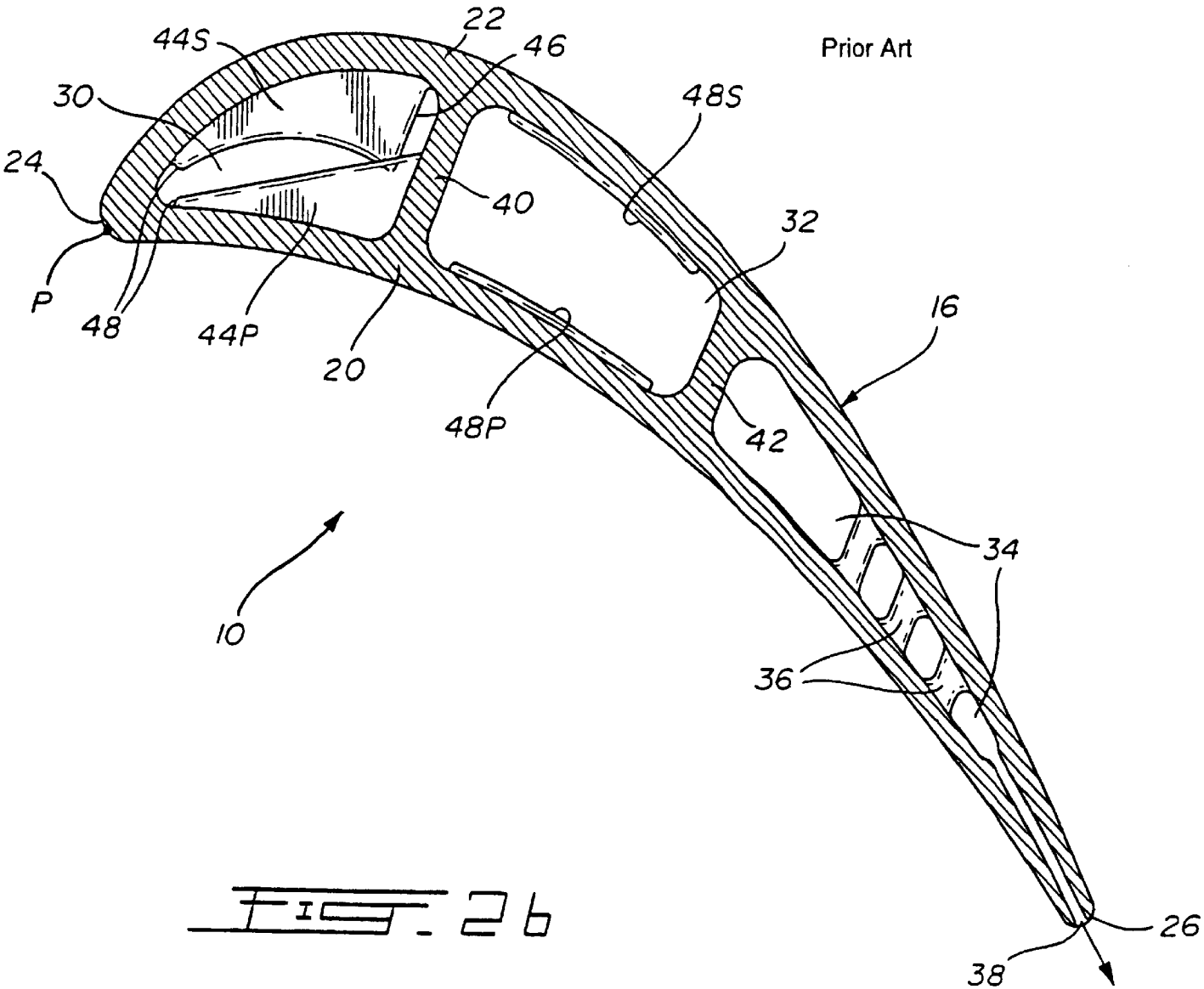

Now referring to FIGS. 1, 2*a* and 2*b*, there is shown an internally convectively cooled blade 10 suited for used as a turbine blade of a conventional gas turbine engine (not shown).

The cooled blade 10 comprises a root section 12, a platform section 14 and a hollow airfoil section 16 over which flows hot combustion gases emanating from a combustor (not shown) forming part of the gas turbine engine. The root section 12, the platform section 14 and the airfoil section 16 are typically integrally cast as a unitary structure.

According to one application of the present invention, the cooled blade 10 extends radially from a rotor (not shown) and is connected thereto via the root section 12. The root section 12 defines a fluid passage 18 which is in fluid communication with a source of pressurized cooling fluid, typically pressurized air emanating from a compressor (not shown) of the gas turbine engine.

The hollow airfoil section 16 includes a pressure side wall 20 and a suction side wall 22 joined together at longitudinally extending leading and trailing edges 24 and 26. The airfoil section 16 further includes a tip wall 28 at a distal end thereof. As seen in FIGS. 1, 2*a* and 2*b*, the airfoil section 16 defines an internal cooling passageway 29 arranged in a serpentine fashion and through which the cooling air is passed to convectively cool the blade 10, as depicted by arrows 27 in FIG. 1.

The cooling passageway 29 includes a leading edge cooling passage 30 extending in the spanwise or longitudinal direction of the blade 10 adjacent the leading edge wall 24 thereof. The leading edge cooling passage 30 is in flow communication with passage 18 and extends to the tip wall 28 of the blade 10 where the coolant air is deviated 180° degrees into a central cooling passage 32, as seen in FIG. 1. The cooling air then flows longitudinally into the central cooling passage 32 towards the root section 12 of the blade 10 before being deviated 180° degrees longitudinally into a trailing edge cooling passage 34 which extends to the tip wall 28 and in which a plurality of spaced-apart pedestals 36 are provided between the pressure and suction side walls 20 and 22 of the cooled blade 10. The cooling air is typically discharged from the trailing edge cooling passage 34 via a plurality of exhaust ports 38 defined at selected locations through the trailing edge 26, as seen in FIGS. 2*a* and 2*b*.

The leading edge cooling passage 30 is delimited by the pressure and suction side walls 20 and 22, the leading edge wall 24 and a partition wall 40 extending in the longitudinal direction of the blade 10 between the pressure and suction side walls 20 and 22. As seen in FIG. 1, the partition wall 40 forms a gap with the tip wall 28 for allowing the cooling air to flow from the leading edge cooling passage 30 into the central or midchord cooling passage 32. Similarly, a second partition wall 42 (see FIGS. 2*a* and 2*b*) extends longitudinally from the tip wall 28 of the cooled blade 10 towards the root section 12 between the pressure and suction side walls 20 and 22 for separating the central cooling passage 32 from the trailing edge cooling passage 34 and, thus, cause the cooling air to flow in a serpentine fashion towards the exhaust ports 38 defined through the trailing edge 26 of the cooled blade 10.

The external heat load is usually more important at the leading edge 24 and, more particularly, at a stagnation point P located thereon. Furthermore, the external surface of the leading edge region of the airfoil section 16 which is exposed to the hot gas is large compared to that exposed to the cooling air. Therefore, it is desirable to promote heat transfer to the cooling air in the leading edge region of the blade 10 in order to keep the cooling flow requirements to a minimum.

It has been found that by causing the cooling air to flow towards the leading edge 24 in a pair of counter-rotating vortices $V_1$ and $V_2$ (see FIG. 4), an efficient cooling of this region of the blade 10 can be achieved.

According to one embodiment of the present invention, this is accomplished by providing a heat transfer promotion structure comprising a plurality of trip-strips or ribs having variable dimensions in a lengthwise direction thereof, the dimensions of the trip strips being set to produce the desired flow pattern and augmentation in local heat transfer coefficient in accordance with the non-uniform external heat load exerted on the blade 10.

More specifically, as seen in FIGS. 1, 2*a* and 2*b*, a first array of parallel trip strips or ribs 44s of variable dimensions extend from an inner surface of the suction side wall 22 at angle θ with respect to a longitudinal axis of the leading edge cooling passage 30 or to the direction of the cooling flow. The value of θ may be comprised in a range of about 20° degrees to about 60° degrees. However, the preferred range of angle θ is between 40° degrees to 50° degrees. As seen in FIGS. 2*a* and 2*b*, a second array of parallel trip strips or ribs 44*p* of variable dimensions extend from an inner surface of the pressure side wall 20. The trip strips 44*p* are parallel and staggered with respect to the trip strips 44*s* such that the trip strips 44*p* and 44*s* extend alternately in succession across the leading edge cooling passage 30.

The trip strips 44*p* and 44*s* may or may not extend to the partition wall 40 and are spaced from the leading edge wall 24.

The leading edge cooling passage 30 has a generally triangular cross-section and has a height (H) at any point along a line which is perpendicular to a meanline of the leading edge cooling passage 30, as seen in FIG. 2*a*. The trip strips 44*p* and 44*s* have a height (h) (see FIG. 2*a*) and a width (w)(see FIG. 1) defining a w/h ratio. The preferred value of the ratio w/h is comprised in a range of 0.05 to 20 inclusively. The preferred value of the strip-to-passage height ratio h/H is comprised in a range of 0.05 to 1.0 inclusively.

The dimensions of each trip strips 44*s* and 44*p* generally gradually decrease from a first end 46 to a second end 48 thereof, the second end being disposed upstream of the first end 46 and closer to the leading edge 24. The width (w), the height (h) and/or the w/h ratio may be varied along the length of each trip strips 44*s* and 44*p* to induce the desired flow pattern which will promote heat transfer in the leading edge region of, the blade 10.

The trip strips 44*p* and 44*s* are typically integrally cast with the associated side wall 20 and 22.

Conventional trip strips 48*p* and 48*s* of uniform sizes can be provided in the central cooling passage 32 to promote heat transfer therein. The orientation of trip strips 44*p*, 44*s*, 48*p* and 48*s* can generally be the same. It is understood that the swirling movement of the air may be carried over from one passage to the next. However, this is not necessarily the case, as it may be eradicated by a 180° turn and then re-started by the next set of trip strips.

Figure 3:
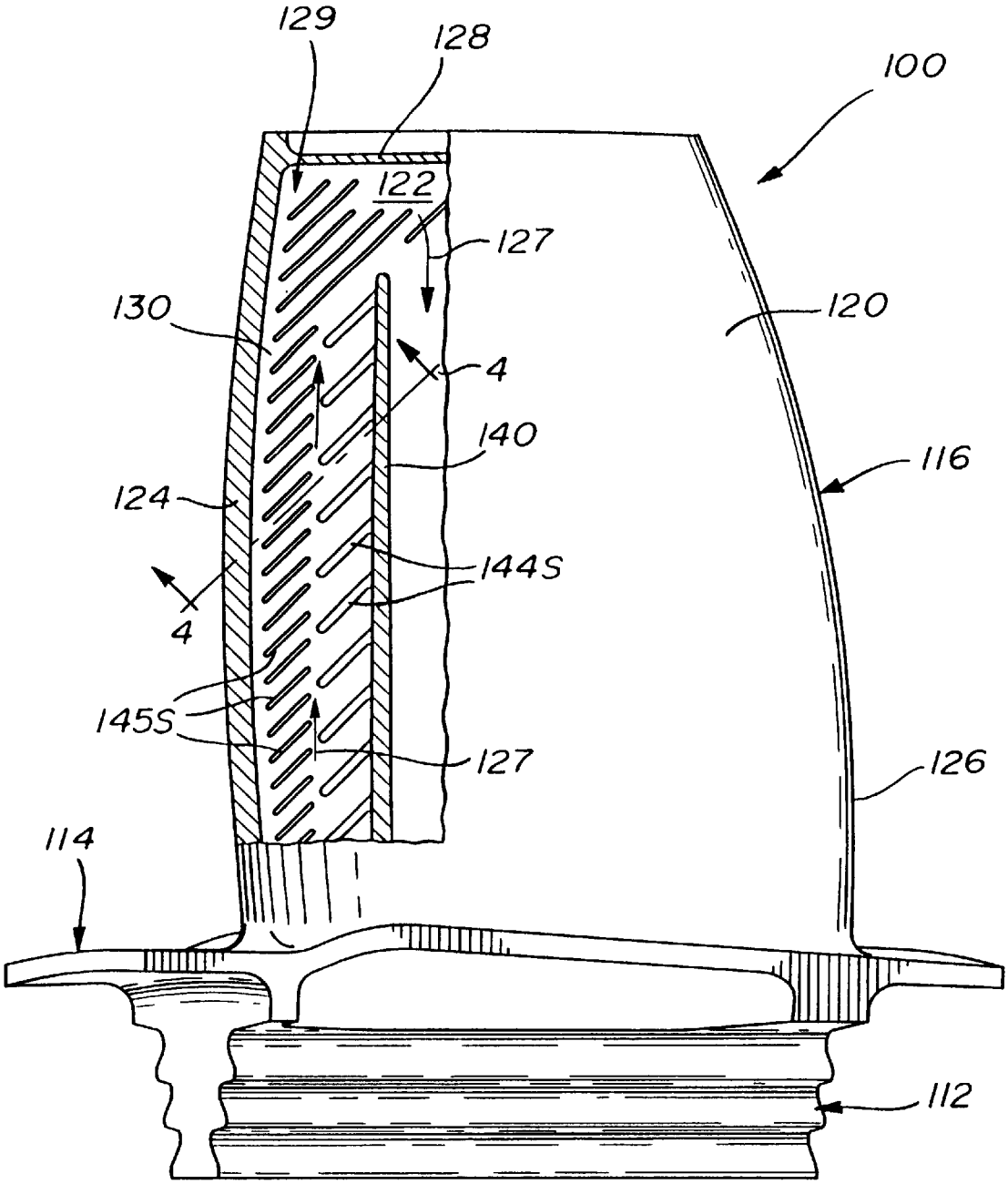
FIG. 3 is a partly broken away longitudinal sectional view of an internally convectively cooled blade in accordance with a second embodiment of the present invention.
Figure 4:
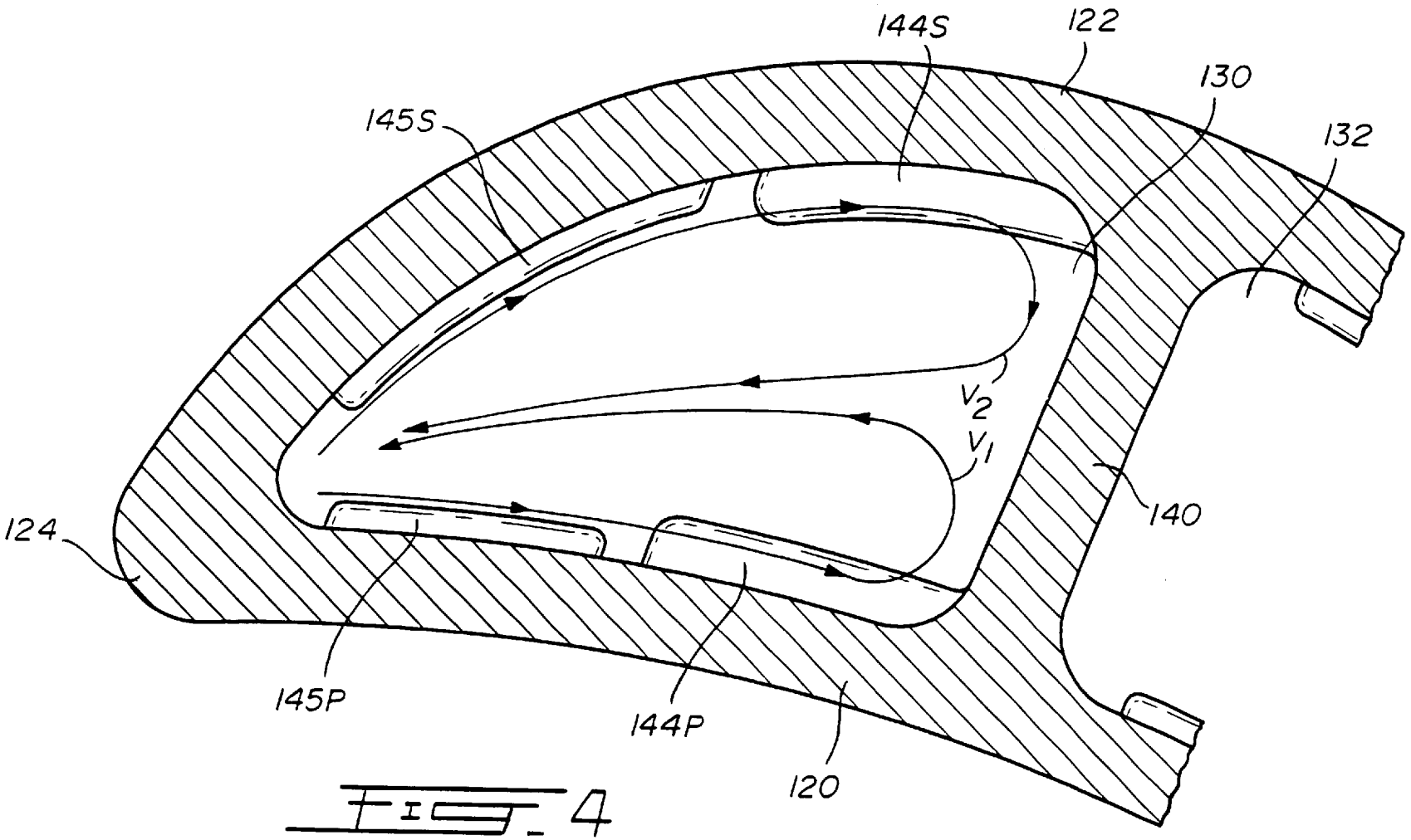
FIG. 4 is an enlarged cross-sectional view taken along line 4—4 of FIG. 3.

According to a second embodiment of the present invention which is illustrated in FIGS. 3 and 4, the cooling air may be caused to flow in a pair counter-rotating vortices V1 and V2 within a triangular or trapezoidal passage by providing a plurality of trip strips 144*s* and 144*p* of uniform but different dimensions within the passage. For simplicity and brevity, components which are identical in function and identical or similar in structure to corresponding components of the first embodiment are given the same reference numerals in the hundreds, and a description of these components is not repeated.

More specifically, as seen in FIG. 3, a first array of parallel trip strips 144*s* extend from the suction side wall 122 and the partition wall 140 in a crosswise direction with respect to the flow direction and the longitudinal axis of the leading edge cooling passage 130. However, it is understood that the trip strips 144*s* do not necessarily have to extend to the partition wall 140. Each trip strips 144*s* is of uniform dimensions. The trip strips 144*s* are uniformly distributed along the longitudinal axis of the leading edge cooling passage 130. A second array of parallel trip strips 145*s*, which are spaced from the distal end of the first trip strips 144*s*, extend from the suction side wall 122. The trip strips 145*s* are disposed closer to the leading edge 124 than the first array of trip strips 144*s* . Each trip strips 145*s* is of uniform dimensions. The second trip strips 145*s* are generally smaller than the first trip strips 144*s*. The height (h) and the width (w) of the trip strips 145*s* are less than the height (h) and the width (w) of the trip strips 144*s*. The dimensions of the trip strips 144*s* and 145*s* are set to provide the desired variable heat transfer coefficient distribution across the leading edge cooling passage 130.

As seen in FIG. 3, the second trip strips 145*s* are uniformly longitudinally distributed within the leading edge cooling passage 130. The spacing between adjacent trip strips 145*s* is less than the spacing between adjacent trip strips 144*s*.

As seen in FIG. 4, third and fourth corresponding arrays of trip strips 144*p* and 145*p* of uniform but different dimensions extend from the pressure side wall 120 inwardly into the leading edge cooling passage 130. The third and fourth arrays of trip strips 144*p* and 145*p* are respectively longitudinally staggered with respect to corresponding first and second arrays of trip strips 144*s* and 145*s*.

In the leading edge cooling passage 130, the provision of the trip strips 144*s*, 144*p*, 145*s* and 145*p* causes the cooling air to flow in a pair of counter-rotating vortices $V_1$ and $V_2$. The first vortex $V_1$ defines a vortex line extending from the leading edge area generally in parallel with an inner surface of the pressure side wall 120 and then back towards the leading edge area. Likewise, the second vortex $V_2$ defines a vortex line which extends from the leading edge area generally in parallel to an inner surface of the suction side wall 122 and then back towards the leading edge area.

In addition to the benefits of the first embodiment, the second embodiment has the advantages of being easier to manufacture and to allow for different spacing for different sized trip strips.

Figure 5:
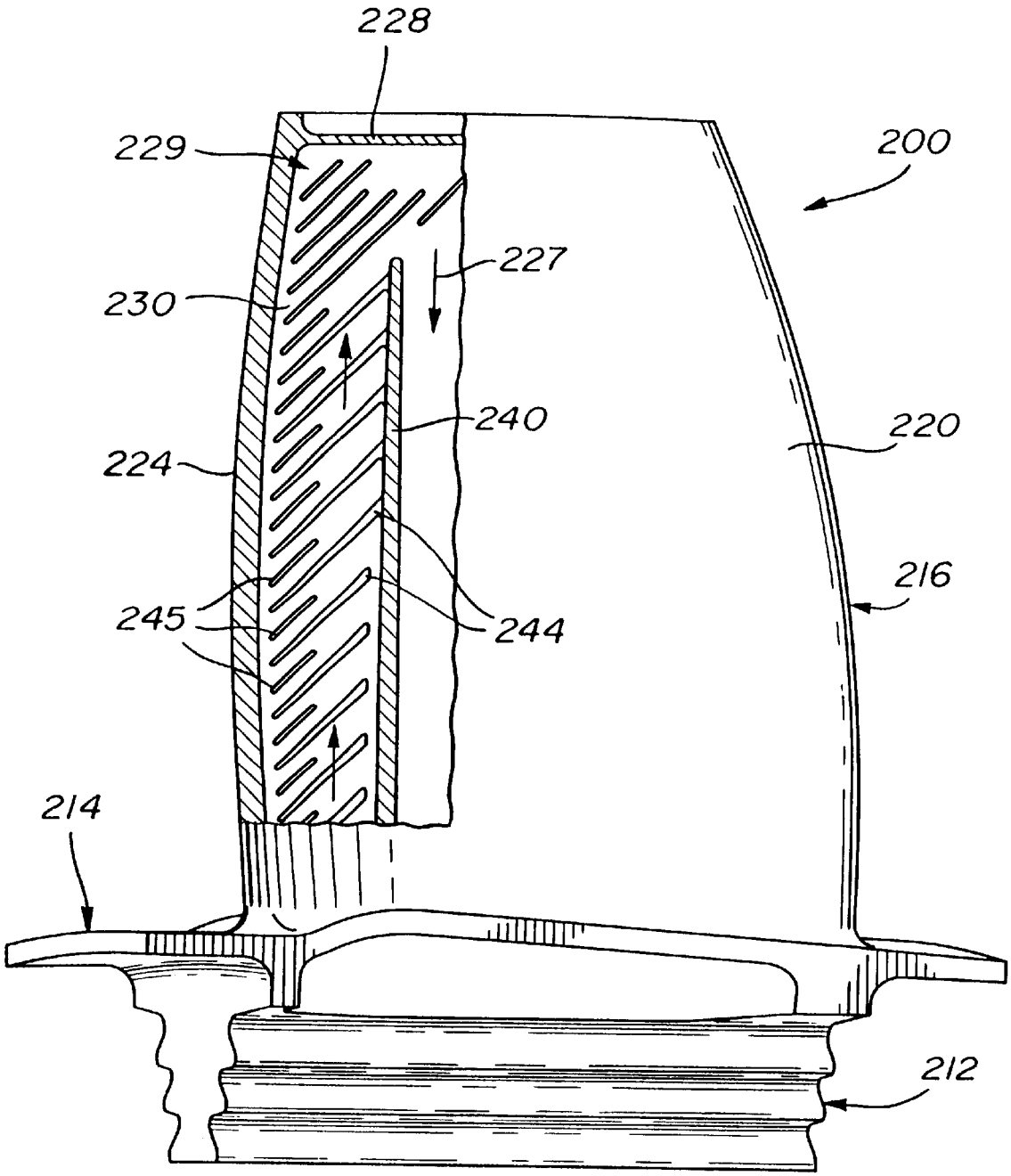
FIG. 5 is a partly broken away longitudinal sectional view of an internally convectively cooled blade in accordance with a third embodiment of the present invention.

FIG. 5 illustrates a third embodiment of the present invention, wherein for simplicity and brevity, components which are identical in function and identical or similar in structure to corresponding components of the first embodiment are given the same reference numerals raised by the two hundred, and a description of these components is not repeated. According to the embodiment illustrated in FIG. 5, a first array of trip strips 244 of variable dimensions and a second array of uniformed sized trip strips 245 extend from the pressure side wall 220 as well as from the opposed suction side wall (not shown) of the cooled blade 200. It is understood that any permutation of the first two embodiments of the present invention may be used in a same passage to produce the desired results.

It is understood that the present invention could apply to a variety of cooling schemes, including leading edge cooling passages that only extend half way up the leading edge. Also, the leading edge passage may end in a 90° turn, instead of a 180° turn, as described hereinbefore. It is also understood that the remainder of the cooling scheme, i.e. past the leading cooling passage, is immaterial to the functioning of the present invention. Finally, it is understood that the present invention is not restricted to large trip strips near the root of the airfoil and smaller ones near the tip thereof.

What is claimed is:

1. A coolable gas turbine engine airfoil structure having a leading edge, a leading edge internal cooling passage through which a cooling fluid is circulated to convectively cool the airfoil structure, and a heat transfer promotion structure provided within said leading edge internal cooling passage, said heat transfer promotion structure comprising a plurality of trip strips arranged to cause said cooling fluid to flow towards said leading edge in a pair of counter-rotating vortices, thereby promoting heat transfer at said leading edge, wherein the plurality of trip strips includes a first array of trip strips and a second array of trip strips, the first array being disposed generally farther from said leading edge than the second array, the trip strips of the second array being spaced closer to one another than the trip strips of the first array, and wherein the height of the trip strips of the-first array is generally greater than the height of the trip strips of the second array.

2. A coolable gas turbine engine airfoil structure as defined in claim 1, wherein each of said trip strips has a height (h) and a width (w) defining a w/h ratio, and wherein within said plurality of trip strips at least one of said height (h), said width (w) and said w/h ratio is varied along a transversal axis relative to said leading edge internal cooling passage.

3. A coolable gas turbine engine airfoil structure as defined in claim 2, wherein each of said trip strips has first and second opposed ends, said second end being disposed closer to said leading edge than said first end and upstream with respect to said first end.

4. A coolable gas turbine engine airfoil structure as defined in claim 3, wherein each of said trip strips is oriented at an acute angle θ with respect to a longitudinal axis of said leading edge internal cooling passage, and wherein θ is comprised in a range of about 20° to about 60° degrees.

5. A coolable gas turbine engine airfoil structure as defined in claim 2, wherein said first array of transversally extending trip strips is longitudinally distributed within said leading edge internal cooling passage, each said transversally extending trip strip of said first array having variable dimensions from a first end to a second opposed end thereof, said variable dimensions resulting from a variation of at least one of said height (h), said width (w) and said w/h ratio.

6. A coolable gas turbine engine airfoil structure as defined in claim 5, wherein said variable dimensions of each of said transversally extending trip strip of said first array decrease from a maximum value at said first end thereof to a minimum value at said second end thereof, said second end being disposed closer to said leading edge than said first end.

7. A coolable gas turbine engine airfoil structure as defined in claim 6, wherein said airfoil structure has a pressure side wall and a suction side wall, said first array of transversally extending trip strips being disposed on said pressure side wall, whereas said second array of transversally extending trip strips is disposed on said suction side wall in a staggered manner with respect to said first array of transversally extending trip strips.

8. A coolable gas turbine engine airfoil structure as defined in claim 5, wherein the height (h) of said first array of trip strips decreases along a trip strip length.

9. A coolable gas turbine engine airfoil structure as defined in claim 2, wherein said transversally extending trip strips of said first array are further different from said transversally extending trip strips of said second array in at least one of said width (w) and said w/h ratio.

10. A coolable gas turbine engine airfoil structure as defined in claim 9, wherein said first and second arrays of transversally extending trip strips are staggered with respect to one another such that said transversally extending trip strips of said first and second arrays are disposed in alternating succession along a longitudinal axis of said leading edge internal cooling passage.

11. A coolable gas turbine engine airfoil structure as defined in claim 10, wherein each of said trip strips of said first array is of variable dimensions from a first end to a second opposed end thereof, whereas said transversally extending trip strips of said second array are of uniform dimensions.

12. A coolable gas turbine engine airfoil structure as defined in claim 9, wherein each said transversally extending trip strip of said first and second arrays has first and second opposed ends, said second end being disposed closer to said leading edge than said first end and upstream with respect thereto.

13. A coolable gas turbine engine airfoil structure as defined in claim 9, wherein said transversally extending trip strips of said first and second arrays are of uniform but different dimensions, said transversally extending trip strips of said second arrays being smaller in length than said transversally extending trip strips of said first arrays.

14. A coolable gas turbine engine airfoil structure as defined in claim 9, wherein third and fourth arrays of transversally extending trip strips corresponding respectively to said first and second arrays of transversally extending trip strips are disposed on an inner surface of one of a pressure side wall and a suction side wall opposed to said first and second arrays of transversally extending trip strips, and wherein said third and fourth arrays are respectively longitudinally staggered with respect to the first and second arrays.

15. A coolable gas turbine engine airfoil structure as defined in claim 2, wherein within said plurality of trip strips at least one of said height (h) and said width (w) is varied from a maximum value to a minimum value along said transversal axis towards said leading edge, said minimum value being in proximity of said leading edge.

16. A coolable gas turbine engine airfoil structure as defined in claim 15, wherein said w/h ratio is comprised within a range of 0.05 to 20 inclusively.

17. A coolable gas turbine engine airfoil structure as defined in claim 16, wherein said leading edge internal cooling passage has a local height (H) and wherein h/H is locally defined by:

$$0.05 \leqq h/H \leqq 1.0.$$

18. A coolable gas turbine engine airfoil structure as defined in claim 1, wherein the trip strips of said first and second arrays have a width, and wherein the width of the trip strips of the second array is less than the width of the trip strips of said first array.

19. A cooled airfoil structure for a gas turbine engine, comprising first and second opposed side walls joined together at a leading edge and a trailing edge, a leading edge internal cooling passage for passing a cooling fluid therethrough to convectively cool the airfoil structure, and a heat transfer promotion structure provided within said internal cooling passage, said heat transfer promotion structure including a plurality of trip strips arranged inside said leading edge internal cooling passage to effect a variable heat transfer coefficient distribution, each of said trip strips having a height (h) and a width (w) defining a w/h ratio, wherein within said plurality of trip strips at least one of said height (h), said width (w) and said w/h ratio is varied along a transversal axis relative to said leading edge internal cooling passage, wherein said plurality of trip strips are arranged to define first and second arrays of transversally extending trip strips, the first array being disposed generally farther from said leading edge than the second array, and wherein the height (h) of the first array of trip strips decreases in a region of said leading edge.

20. A cooled airfoil structure as defined in claim 19, wherein within said plurality of trip strips at least one of said height (h) and said width (w) is varied from a maximum value to a minimum value along said transversal axis towards said leading edge, said minimum value being provided in proximity of said leading edge.

21. A cooled airfoil structure as defined in claim 20, wherein said w/h ratio is comprised within a range of 0.05 to 20 inclusively.

22. A cooled airfoil structure as defined in claim 21, wherein said internal cooling passage has a local height (H) and wherein h/H is locally defined by:

$$0.05 \leqq h/H \leqq 1.0.$$

23. A cooled airfoil structure as defined in claim 19, wherein each said transversally extending trip strip of said first array has variable dimensions from a first end to a second-opposed end thereof, said variable dimensions resulting from a variation of at least one of said height (h), said width (w) and said w/h ratio.

24. A cooled airfoil structure as defined in claim 23, wherein said variable dimensions of each said transversally extending trip strip decrease from a maximum value at said first end thereof to a minimum value at said second end thereof, said second end being disposed closer to said leading edge than said first end and upstream with respect thereto.

25. A cooled airfoil structure as defined in claim 24, wherein said first array of transversally extending trip strips is disposed on an inner surface of said first side wall, whereas said second array of transversally extending trip strips is disposed on an inner surface of said second side wall in a staggered manner with respect to said first array of transversally extending trip strips.

26. A cooled airfoil structure as defined in claim 19, wherein said transversally extending trip strips of said first array differ from said transversally extending trip strips of said second array in at least one of said height (h), said width (w) and said w/h ratio.

27. A cooled airfoil structure as defined in claim 26, wherein said transversally extending trip strips of said first and second arrays are of uniform but different dimensions, said transversally extending trip strips of said second array being smaller in length than said transversally extending trip strips of said first array.

28. A cooled airfoil structure as defined in claim 26, wherein each of said trip strips of said first array is of variable dimensions from a first end to a second opposed end thereof, whereas said transversally extending trip strips of said second array are of uniform dimensions.

29. A cooled airfoil structure as defined in claim 28, wherein third and fourth rows of transversally extending trip strips corresponding respectively to said first and second rows of transversally extending trip strips are disposed on an inner surface of one of said first and second side walls opposed to said first and second rows of transversally extending trip strips.

30. A cooled airfoil structure as defined in claim 19, wherein each of said trip strips has first and second opposed ends, said second end being disposed closer to said leading edge than said first end and upstream of said first end so as to define an acute angle θ with respect to a longitudinal axis of said internal cooling passage, and wherein θ is comprised in a range of about 20° to about 60° degrees.

31. A cooled airfoil structure as defined in claim 19, wherein the height (h) of the first array of trip strips decreases along a trip strip length, whereas the height (h) of the second array of trip strips is substantially constant.

32. A cooled airfoil structure as defined in claim 19, wherein the width (w) of the trip strips of the second array is less than the width of the trip strips of said first array.

33. A coolable gas turbine engine airfoil structure having a leading edge, a leading edge internal cooling passage through which a cooling fluid is circulated to convectively cool the airfoil structure, and a heat transfer promotion structure provided within said leading edge internal cooling passage, the passage having a leading edge side disposed closer to the airfoil leading edge than a second side, said heat transfer promotion structure comprising a plurality of spaced-apart trip strips having ends and being arranged to cause said cooling fluid to flow towards said leading edge in a pair of counter-rotating vortices, thereby promoting heat transfer at said leading edge, wherein the plurality of trip strips includes a first array of trip strips and a second array of trip strips, the first array being disposed generally farther from said leading edge than the second array, the trip strips of the first array having a height generally greater than the height of the trip strips of the second array, and wherein the plurality of trip strips are arranged such that the ends of adjacent trip strips closest the leading edge side of the passage are spaced closer together than the ends of adjacent trip strip ends closest the second side of the passage.

34. A coolable gas turbine engine airfoil structure as defined in claim 33, wherein the trip strips of said first and second arrays have a width, and wherein the width of the trip strips of the second array is less than the width of the trip strips of said first array.

35. A coolable gas turbine engine airfoil structure as defined in claim 33, wherein the height (h) of said first array of trip strips decreases along a trip strip length.

36. A coolable gas turbine engine airfoil structure as defined in claim 33, wherein the height (h) of the first array of trip strips is constant.

37. A coolable gas turbine engine airfoil structure as defined in claim 33, wherein the first and second arrays are longitudinally staggered along said leading edge internal cooling passage.

38. A coolable gas turbine engine airfoil structure as defined in claim 33, wherein the trip strips of the second array are spaced closer to one another than the trip strips of the first array.

39. A coolable gas turbine engine airfoil structure having a leading edge, a leading edge internal cooling passage through which a cooling fluid is circulated to convectively cool the airfoil structure, and a heat transfer promotion structure provided within said leading edge internal cooling passage, said heat transfer promotion structure comprising a plurality of trip strips arranged to cause said cooling fluid to flow towards said leading edge in a pair of counter-rotating vortices, thereby promoting heat transfer at said leading edge, wherein the plurality of trip strips includes a first array of trip strips and a second array of trip strips, the first array being disposed generally farther from said leading edge than the second array, the trip strips of the second array being spaced closer to one another than the trip strips of the first array, and wherein the trip strips of the first array have a width which is generally greater than the width of the trip strips of the second array.

40. A coolable gas turbine engine airfoil structure as defined in claim 39, wherein the trip strips of said first array have a height generally greater than the height of the trip strips of said second array.

41. A coolable gas turbine engine airfoil structure as defined in claim 39, wherein said trip strips extend generally in a crosswise direction with respect to a longitudinal axis of the leading edge internal cooling passage, and wherein the height (h) of said first array of trip strips decreases along a trip strip length in a direction towards said leading edge.

* * * * *